US011162496B2

(12) United States Patent
Mayleben

(10) Patent No.: US 11,162,496 B2
(45) Date of Patent: Nov. 2, 2021

(54) PUMP WITH EXTERNAL ELECTRICAL COMPONENTS AND RELATED METHODS

(71) Applicant: Wayne/Scott Fetzer Company, Westlake, OH (US)

(72) Inventor: Philip Anthony Mayleben, Brookville, IN (US)

(73) Assignee: Wayne/Scott Fetzer Company, Westlake, OH (US)

( * ) Notice: Subject to any disclaimer, the term of this patent is extended or adjusted under 35 U.S.C. 154(b) by 146 days.

(21) Appl. No.: 15/811,131

(22) Filed: Nov. 13, 2017

(65) Prior Publication Data

US 2018/0135633 A1 May 17, 2018

Related U.S. Application Data

(60) Provisional application No. 62/420,988, filed on Nov. 11, 2016.

(51) Int. Cl.

| | |
|---|---|
| ***F04D 13/08*** | (2006.01) |
| ***F04D 29/58*** | (2006.01) |
| *F04D 13/06* | (2006.01) |

(52) U.S. Cl.

CPC ..... *F04D 13/086* (2013.01); *F04D 29/5813* (2013.01); *F04D 13/068* (2013.01)

(58) Field of Classification Search

CPC .... F04D 13/08; F04D 13/086; F04D 15/0218; F04D 15/0236; F04D 29/58;

(Continued)

(56) References Cited

U.S. PATENT DOCUMENTS 2,687,693 A * 8/1954 Hudson ..... F04D 15/0218 417/18

2,804,516 A 8/1957 Staak (Continued)

FOREIGN PATENT DOCUMENTS

| | | |
|---|---|---|
| CA | 2420650 | 9/2004 |
| EP | 0373809 | 6/1990 |

(Continued)

OTHER PUBLICATIONS

U.S. Patent and Trademark Office, non-final Office Action issued in U.S. Appl. No. 12/049,906, dated Feb. 13, 2012, 13 pp.

(Continued)

*Primary Examiner* — Kenneth J Hansen

(74) *Attorney, Agent, or Firm* — Fitch, Even, Tabin & Flannery LLP

(57) ABSTRACT

A submersible pump and related methods are disclosed herein. The pump assembly includes a pump housing and a motor with a motor housing/cap and an output shaft connected to an impeller that is disposed in a volute. In some forms, a separate power circuit compartment is formed integral to one of the pump housing and/or volute to store power circuitry that allows a DC pump to be used and powered by AC voltage. In other forms, the power circuit compartment is formed separate from the pump assembly and fastened or connect to the pump assembly. In preferred forms, the power circuit compartment is positioned relative to the pump assembly at a point where it will be maintained at least partially within the fluid surrounding the pump to dissipate heat from the power circuit. Numerous methods are also disclosed and contemplated herein.

19 Claims, 6 Drawing Sheets

(58) Field of Classification Search
CPC ..... F04D 29/588; F04D 47/06; F04D 13/068; F04D 29/5813; F04D 29/586; H02K 5/132
USPC ..... 417/366; 310/62, 63
See application file for complete search history.

(56) References Cited

U.S. PATENT DOCUMENTS 2,910,003 A 10/1959 Kaatz
2,969,740 A 1/1961 Kaatz
3,021,788 A 2/1962 Kaatz
3,144,832 A 8/1964 Haynes
3,352,246 A * 11/1967 Inoue ..... F04D 15/0218 417/36
3,399,399 A 8/1968 Apfelbaum
3,556,677 A 1/1971 Tremain
3,588,859 A 6/1971 Petree
3,634,842 A 1/1972 Niedermeyer
3,665,300 A 5/1972 Sauer
3,726,606 A 4/1973 Peters
3,882,476 A 5/1975 Lofgren
3,932,853 A 1/1976 Cannon
3,941,507 A 3/1976 Niedermeyer
3,945,771 A 3/1976 Arakawa
3,951,568 A 4/1976 Carlson
3,992,130 A 11/1976 Childress
3,999,890 A 12/1976 Niedermeyer
4,108,574 A 8/1978 Bartley
4,137,527 A 1/1979 Tennenhouse
4,187,503 A 2/1980 Walton
4,215,975 A 8/1980 Niedermeyer
4,222,711 A 9/1980 Mayer
4,228,427 A 10/1980 Niedermeyer
4,276,454 A 6/1981 Zathan
4,291,261 A 9/1981 Johnston
4,339,231 A 7/1982 Conery
4,361,835 A 11/1982 Nagy
4,369,438 A 1/1983 Wilhelmi
4,426,271 A 1/1984 Yoshida
4,437,811 A 3/1984 Iwata
4,456,432 A 6/1984 Mannino
4,466,284 A 8/1984 Dumery
4,480,469 A 11/1984 Tice
4,511,312 A 4/1985 Hartwig
4,551,068 A 11/1985 Boudreaux
4,554,494 A 11/1985 Howeth
4,589,282 A 5/1986 Dumery
4,598,584 A 7/1986 Dombrowski
4,600,844 A 7/1986 Atkins
4,631,001 A 12/1986 Keech
4,744,808 A 5/1988 Treu
4,766,329 A 8/1988 Santiago
4,800,755 A 1/1989 Fathauer
4,804,944 A 2/1989 Golladay
4,820,131 A 4/1989 Johnson
4,875,497 A 10/1989 Worthington
4,881,873 A 11/1989 Smith
4,920,797 A 5/1990 Swartz
4,961,018 A 10/1990 Akhter
5,015,152 A 5/1991 Greene
5,017,909 A 5/1991 Goekler
5,055,000 A 10/1991 Akhter
5,145,323 A 9/1992 Farr
5,145,337 A 9/1992 Kirkland
5,181,841 A 1/1993 Kirkland
5,205,725 A 4/1993 Pattison
5,234,319 A 8/1993 Wilder
5,238,369 A 8/1993 Farr
5,283,569 A 2/1994 Nelson
5,287,086 A 2/1994 Gibb
5,449,274 A 9/1995 Kochan
5,483,227 A 1/1996 Kuo
5,549,456 A 8/1996 Burrill
5,562,423 A 10/1996 Orth
5,565,687 A 10/1996 Berrill
5,613,844 A 3/1997 Tuckey
5,636,548 A 6/1997 Dunn
5,672,050 A 9/1997 Webber
5,696,493 A 12/1997 Einck
5,744,701 A 4/1998 Peterson
5,764,034 A 6/1998 Bowman
5,923,102 A 7/1999 Koenig
5,924,846 A 7/1999 Arnold, Jr.
6,028,521 A 2/2000 Issachar
6,218,949 B1 4/2001 Issachar
6,253,611 B1 7/2001 Varga et al.
6,292,051 B1 9/2001 Su
6,322,325 B1 11/2001 Belehradek
6,364,620 B1 4/2002 Fletcher
6,366,053 B1 4/2002 Belehradek
6,373,676 B1 4/2002 Baker
6,375,430 B1 4/2002 Eckert
6,443,715 B1 9/2002 Mayleben
6,446,014 B1 9/2002 Ocondi
6,462,666 B1 10/2002 Einck
6,464,531 B2 10/2002 Eckert
6,481,973 B1 11/2002 Struthers
6,499,961 B1 12/2002 Wyatt
6,557,412 B1 5/2003 Barbier
6,565,325 B2 5/2003 Belehradek
6,588,458 B2 7/2003 Rodgers
6,649,839 B2 11/2003 Eckert
6,676,382 B2 * 1/2004 Leighton ..... F04D 29/2222 417/12
6,703,930 B2 3/2004 Skinner
6,813,946 B1 11/2004 Benton
6,989,649 B2 1/2006 Mehlhorn
7,131,330 B2 2/2006 Gurega
7,023,215 B2 4/2006 Steenwyk
7,053,765 B1 5/2006 Clark
7,093,485 B2 8/2006 Newman
7,153,418 B2 12/2006 Mauro, Sr.
7,165,450 B2 1/2007 Jamnia
7,183,741 B2 2/2007 Mehlhorn
7,209,048 B1 4/2007 Pace
7,222,530 B2 5/2007 Fukuhara
7,230,528 B2 6/2007 Kates
7,264,449 B1 9/2007 Harned
7,307,538 B2 12/2007 Kochan
7,309,216 B1 12/2007 Spadola
7,319,853 B2 1/2008 Luebke
7,373,817 B2 5/2008 Burdi
7,398,682 B2 7/2008 Magers
7,417,552 B1 8/2008 Vaskovic
7,429,842 B2 9/2008 Schulman
7,458,782 B1 12/2008 Spadola
7,509,856 B1 3/2009 Winkens
7,544,041 B2 6/2009 Mayleben
7,612,529 B2 11/2009 Kochan
7,625,187 B2 12/2009 Collins
7,746,243 B2 6/2010 Chen
7,755,318 B1 7/2010 Panosh
7,814,787 B2 10/2010 Sabini
7,854,598 B2 12/2010 Suzuki
7,972,117 B1 7/2011 MacDonald
8,047,805 B2 11/2011 Bourell, Jr.
8,068,026 B1 11/2011 Delerno
8,256,455 B1 9/2012 Ball
8,380,355 B2 2/2013 Mayleben et al.
8,435,009 B2 5/2013 Moore et al.
8,579,600 B2 11/2013 Vijayakumar
8,610,309 B2 12/2013 Kragelund
8,633,623 B2 1/2014 Bingler
8,641,384 B2 2/2014 Bourell, Jr.
8,807,957 B2 2/2014 Hampton
2002/0072270 A1 6/2002 Eckert
2002/0076330 A1 6/2002 Lipscomb
2002/0076331 A1 6/2002 Eckert
2002/0102162 A1 8/2002 Belehradek
2002/0157465 A1 10/2002 Marioni
2002/0176782 A1 11/2002 Batchelder et al.
2003/0019291 A1 1/2003 Pchelnikov
2003/0049134 A1 3/2003 Leighton
2003/0184444 A1 10/2003 Collings

(56) References Cited

U.S. PATENT DOCUMENTS

| | | | | |
|---|---|---|---|---|
| 2004/0118433 | A1 | 6/2004 | Bigott | |
| 2005/0076711 | A1 | 4/2005 | Urquidi | |
| 2005/0099311 | A1 | 5/2005 | Eskins | |
| 2005/0158177 | A1 | 7/2005 | Mehlhorn | |
| 2005/0281679 | A1 | 12/2005 | Niedermeyer | |
| 2006/0008355 | A1 | 1/2006 | Low | |
| 2006/0078435 | A1 | 4/2006 | Burza | |
| 2006/0219962 | A1 | 10/2006 | Dancs | |
| 2007/0258827 | A1 | 11/2007 | Gierke | |
| 2007/0274839 | A1 | 11/2007 | Moskun | |
| 2008/0031751 | A1 | 2/2008 | Littwin | |
| 2008/0031752 | A1 | 2/2008 | Littwin | |
| 2008/0197999 | A1 | 8/2008 | Henderson | |
| 2008/0229819 | A1* | 9/2008 | Mayleben | F04B 49/06 73/304 C |
| 2008/0298978 | A1 | 12/2008 | Schulman | |
| 2009/0123295 | A1 | 5/2009 | Abbott | |
| 2009/0148306 | A1 | 6/2009 | Drechsel | |
| 2009/0208345 | A1 | 8/2009 | Moore | |
| 2010/0180811 | A1 | 7/2010 | Sotiriou | |
| 2011/0085919 | A1 | 4/2011 | Williams | |
| 2011/0110792 | A1 | 5/2011 | Mauro | |
| 2011/0110794 | A1 | 5/2011 | Mayleben | |
| 2011/0215919 | A1 | 9/2011 | Hernandez | |
| 2011/0273288 | A1 | 11/2011 | Kochan | |
| 2011/0311370 | A1 | 12/2011 | Sloss | |
| 2012/0189464 | A1 | 7/2012 | Bourell, Jr. | |
| 2012/0251333 | A1 | 10/2012 | Irwin | |
| 2013/0156605 | A1 | 6/2013 | Mayleben | |
| 2013/0183178 | A1 | 7/2013 | Bottan | |
| 2013/0200171 | A1 | 8/2013 | Hartfelder | |
| 2013/0294931 | A1 | 11/2013 | Magnusson | |
| 2014/0119946 | A1 | 5/2014 | Boese | |
| 2014/0119950 | A1 | 5/2014 | Bishop | |
| 2014/0328696 | A1 | 11/2014 | Bishop | |
| 2015/0147190 | A1 | 5/2015 | Cummings | |

FOREIGN PATENT DOCUMENTS

| | | | |
|---|---|---|---|
| EP | 0903498 | A1 | 3/1999 |
| GB | 2064135 | | 6/1981 |
| WO | 2004095388 | | 11/2004 |
| WO | 2004104529 | | 12/2004 |
| WO | 2006096075 | | 9/2006 |
| WO | 2007024475 | A1 | 3/2007 |
| WO | 2014066551 | A1 | 5/2014 |
| WO | 2014066688 | A1 | 5/2014 |
| WO | 2014151339 | A2 | 9/2014 |

OTHER PUBLICATIONS

U.S. Patent and Trademark Office, non-final Office Action issued in U.S. Appl. No. 12/617,377, dated Jun. 1, 2012, 12 pp.
Blue Angel Pump Company, Blue Angel Catalog, 2018, 34 pp.
Blue Angel Pump Company, Blue Angel Catalog, Oct. 2015, 39 pp.
Wayne Water Systems, Wayne Catalog, Oct. 2014, 52 pp.

* cited by examiner

PUMP WITH EXTERNAL ELECTRICAL COMPONENTS AND RELATED METHODS

CROSS-REFERENCE TO RELATED APPLICATION

This application claims priority to U.S. Application No. 62/420,988, filed on Nov. 11, 2016, which is incorporated herein by reference in its entirety.

FIELD

This invention relates generally to pumps and, more particularly, to submersible water pumps.

BACKGROUND

Most permanent magnet brushed DC motors wound for use with AC power incorporate a fan, or bypass air over the rectifier, and associated electrical components to control temperature. The requirement to cool the electrical components disqualifies this type motor from use in submersible pump applications.

Some submersible pumps utilize oil cooling to cool the motor and electrical components. However, oil cooling is not practical because the brushes wear and carbon particles contaminate the oil, spoiling its di-electric properties.

The high speed capability of permanent magnet DC motors are desirable for small centrifugal pump applications that are otherwise restricted to a speed of 3,600 RPM or less due to the nature of induction motor design at 60 Hz. Also, small brushed DC motors are significantly more efficient than comparable single phase induction motors.

Brushless DC motors offer another alternative to brushed DC motors but at substantially higher cost.

Accordingly, it has been determined that a need exists for improved cooling of the electrical components in a submersible pump.

BRIEF DESCRIPTION OF THE FIGURES

Embodiments of the invention are illustrated in the figures of the accompanying drawings in which.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DESCRIPTION OF THE INVENTION

Many variations of pumps are discussed herein and even further are contemplated in view of this disclosure. For example, some pumps discussed herein are configured, and designed, to be fully submerged in a liquid and to pump the liquid in which it is submerged through an attached outlet hose or outlet pipe. The pumps herein can be utility pumps, sump pumps, well pumps, sewage/effluent pumps, aquarium pumps, pool pumps, lawn pumps, or any other type of pump. The pumps can have a top suction design, bottom suction design, or horizontal design.

Figure 1A:
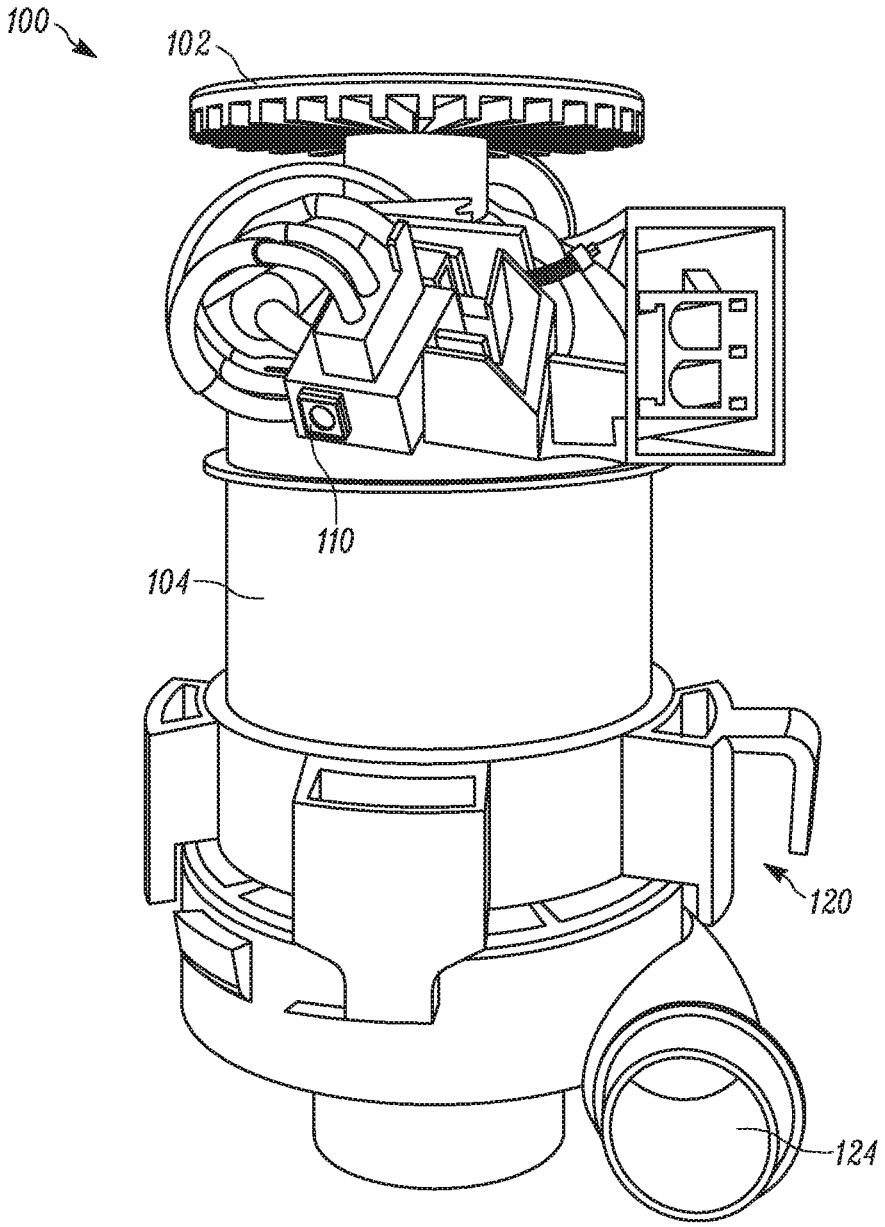
PRIOR ART FIG. 1A
FIGS. 1A-1D show a prior art pump with air cooled electrical components.
Figure 1B:
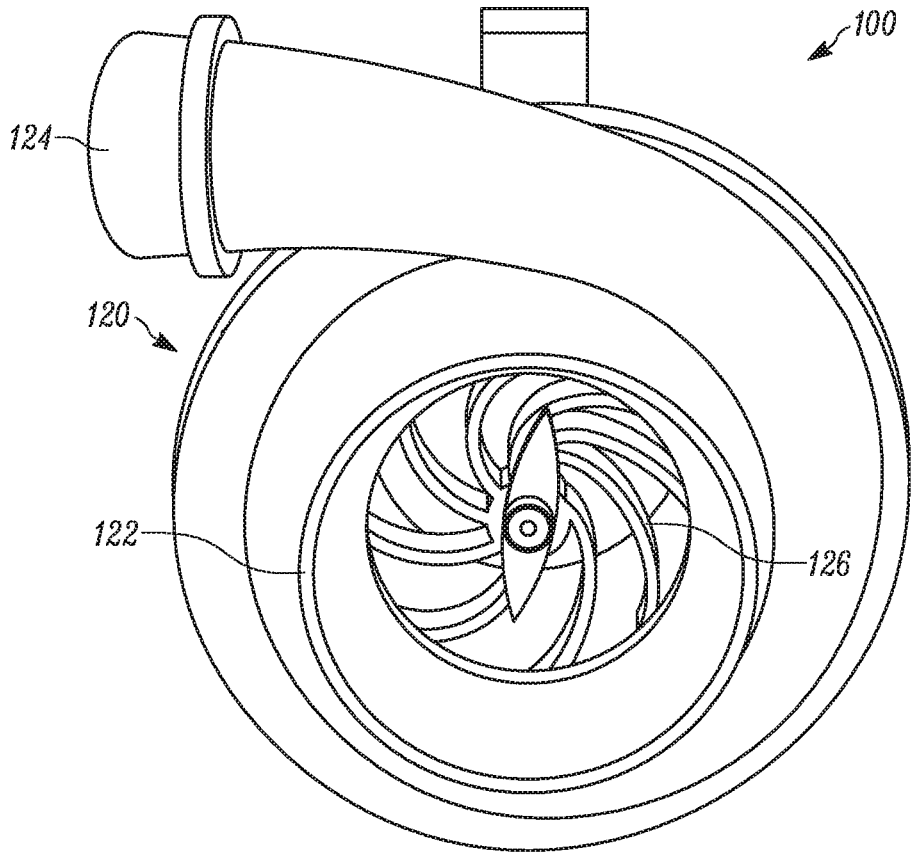
PRIOR ART FIG. 1B
Figure 1C:
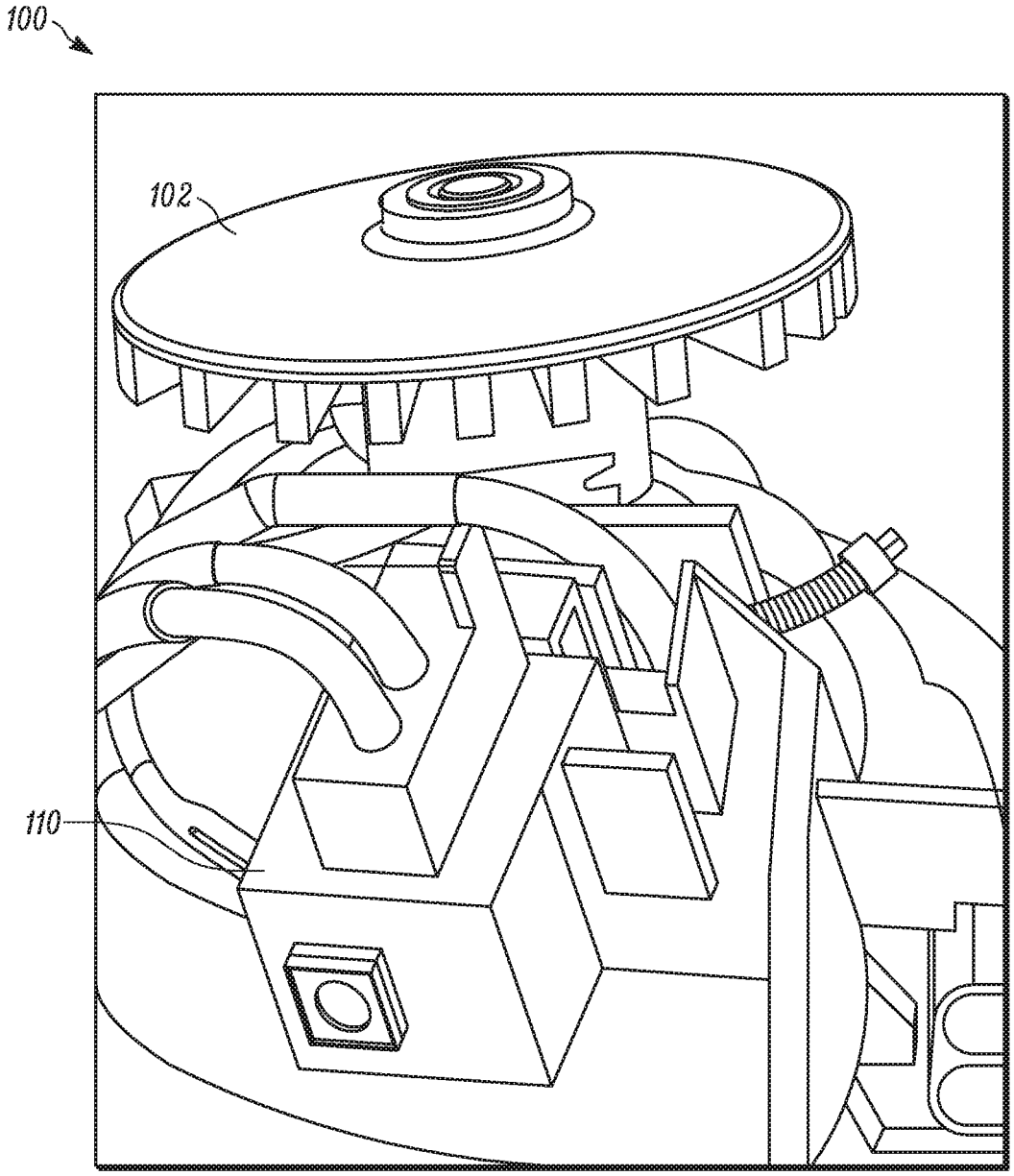
PRIOR ART FIG. 1C
Figure 1D:
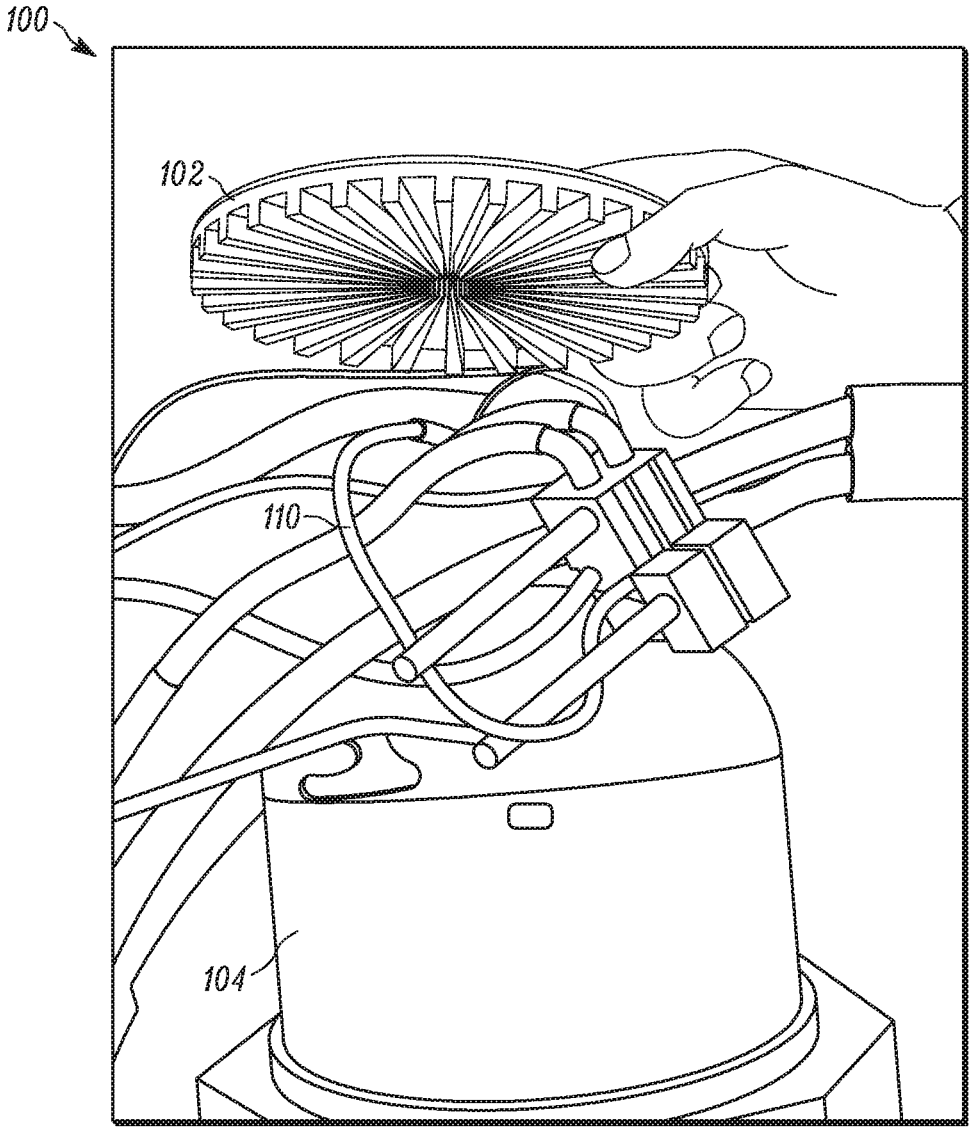
PRIOR ART FIG. 1D

FIGS. 1A-1D show a prior art non-submersible pump 100. FIG. 1A illustrates a side view of the pump 100. FIG. 1B illustrates a bottom view of the pump 100. FIGS. 1C-1D show a close up view of the electrical components 110 and the fan 102. A portion of the housing has been removed from the pump 100 to expose the electrical components 110, additionally the electrical components 110 are pulled apart to further increase visibility. The pump 100 includes electrical components 110 cooled by a fan 102, an electric motor 104, and a pump unit 120. The electrical components 110 include a rectifier for converting 120*v* AC power to DC. The pump unit 120 includes a discharge port 124, and inlet port 122, and an impeller 126. In operation, the electric motor 104 turns the impeller 126 centrifugal action induces fluid flow from the inlet 122 to the discharge 124.

Figure 2:
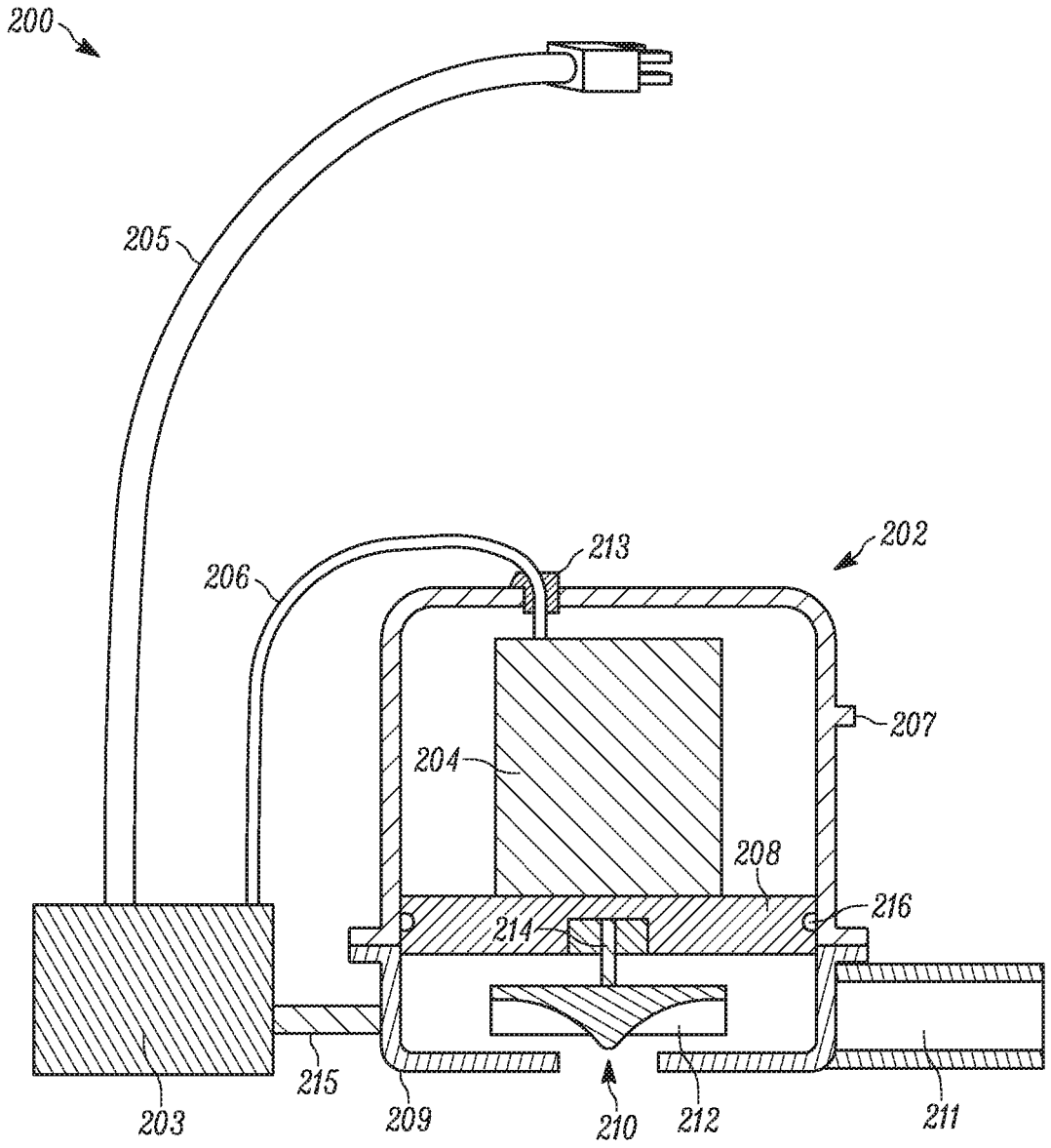
FIG. 2 illustrates a first embodiment of the present invention illustrated in partial cross-section and showing a power control module separate from the motor housing and collector structure.

FIG. 2 illustrates a submersible utility pump 200 according to an embodiment of the present invention. The utility pump 200 includes a power cable 205 configured to plug into a standard AC outlet, an electronic controller enclosure 203, and a motor enclosure 207, and a volute or collector 209. The electronic controller enclosure 203 contains a power circuit for converting AC to DC, such as a rectifier. In this way, the pump 200 is capable of using a DC motor and taking advantage of the extra benefits of a DC motor (e.g., motor control, speed control, etc.) while still powering the motor with a conventional AC power supply (e.g., 120V, 60 Hz outlet connected to mains, etc.). The electronic controller enclosure 203 comprises a sealed body or housing, such as a sealed box or a solid portion of potting compound into which the electronical components are embedded. The sealed body separates the electrical components from the surrounding fluid.

In some embodiments, the electronic controller enclosure 203 also contains other electronic water pump controls (e.g., water level sensors, controllers or control circuits for operating the pump, conducting diagnostic testing, etc.). Example electronic controls include a ground fuse, a temperature fuse, temperature sensors, capacitive water sensors, motor load sensor, and others. While the pump 200 is a bottom suction utility pump, this external controller compartment concept can be utilized with any type of pump (e.g., utility, sump, effluent, aquarium, etc.) and with any type of pump configuration (e.g., top suction, bottom suction, horizontal suction, etc.). Examples of a bottom suction type pump are shown in U.S. Pat. No. 2,701,529, to H. Finzel; Re. 24,909, to R. W. Dochterman; and U.S. Pat. No. 4,345,879, to C. W. Steiner. Examples of a top suction type pump are shown in U.S. Pat. No. 3,234,881, to W. J. Ekey;

and U.S. Pat. No. 4,396,353, to R. D. MacDonald. Examples of a horizontal suction type pump are shown in U.S. Pat. No. 2,608,157, to W. J. Conery. Examples of such pumps are also illustrated in U.S. patent application Ser. No. 12/944,883 which illustrates a utility pump using a solid state water level sensor, and U.S. Provisional Patent Application No. 62/268,811 filed Dec. 17, 2015 which illustrates a battery back-up pump system.

The electronic controls enclosure 203 is connected to the motor enclosure 207 by at least a DC power cable 206. In some embodiments, the electronic controller enclosure 203 is also rigidly attached to the motor enclosure 207 or the collector 209 by a support member 215. For example, in some forms the enclosure 203 is molded with and integral to the motor enclosure 207 and/or the collector 209. In alternate embodiments, however, the enclosure 203 may be removably connected to the motor enclosure 207 and/or collector 209 so as to be serviceable independent of the motor enclosure 207 and/or collector 209. The motor enclosure 207 includes a sealed portion surrounding the electric motor 204, in the illustrated example a permanent magnet DC motor. The sealed portion is sealed by a cable seal 213 and a seal plate 208. The collector 209 is rigidly attached to the motor enclosure 207 and contains a rotating pump impeller 212 which when turned by the electric motor 204 causes fluid to flow into the inlet 210 and out of the discharge 211. The impeller 212 is operably coupled to the electric motor 204 by a shaft 214.

In this embodiment, the heat generated by components within the electronic control unit 203 is released into the surrounding fluid. In some embodiments, the electronic control unit 203 includes a heat sink to increase the heat transfer rate. In alternative embodiments, the electronic controllers are embedded in a potting compound and then submerged directly into the fluid to cool the power circuitry located within enclosure 203.

In some forms, the electronic control unit 203 is positioned relative to the collector 209 such that the flow induced by the impeller 212 pulls fluid past the electronic control unit 203. This flow increases the heat transfer between the electronic control unit 203 and the surrounding fluid.

Figure 3:
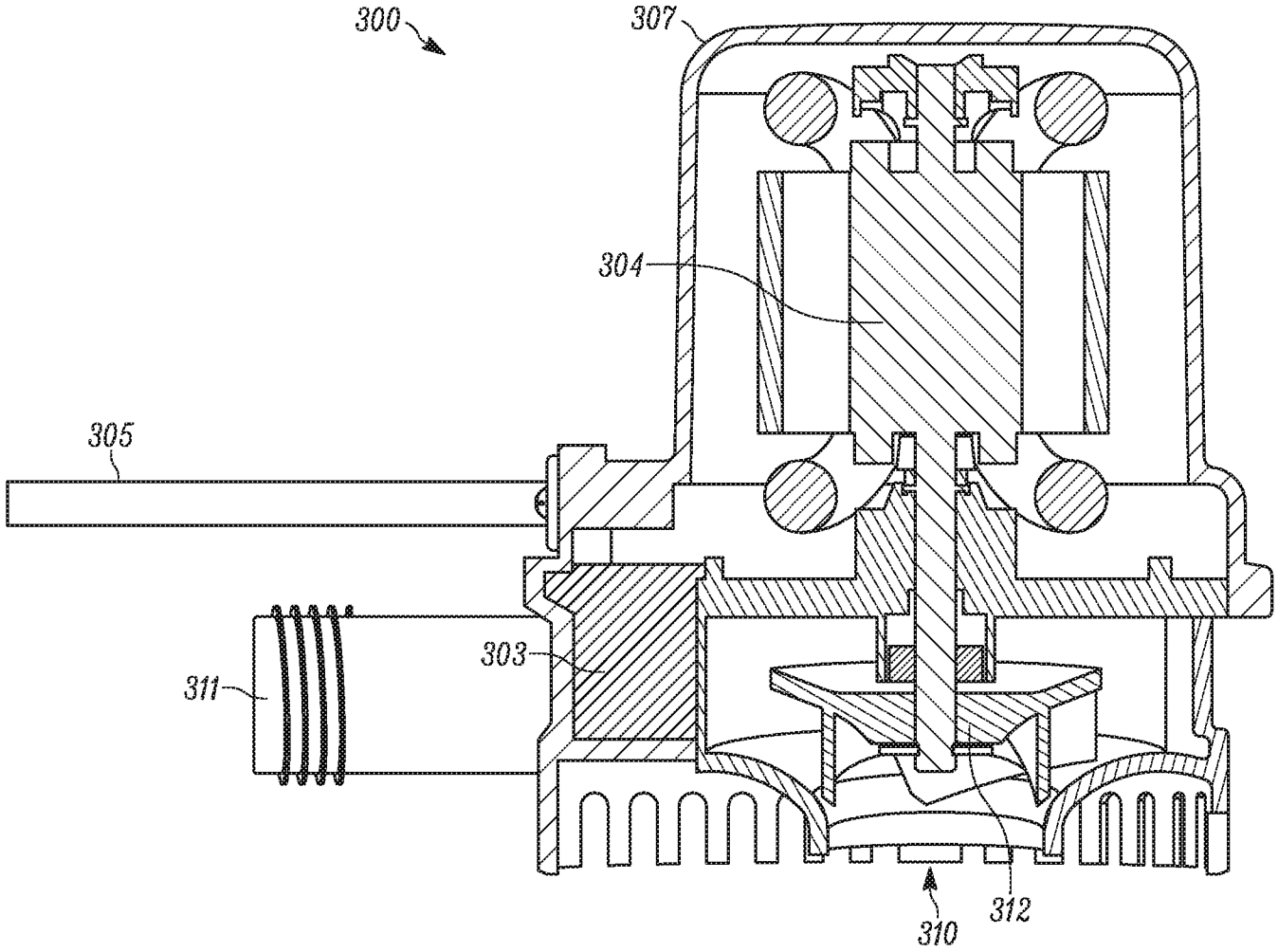
FIG. 3 illustrates a second embodiment of the present invention illustrated in partial cross-section and showing a power control module integrated into the motor housing and/or collector structure, but remote from the cavities defined by the motor housing and/or collector structure.

In a second embodiment of a submersible utility pump 300 according to the present invention, as shown in FIG. 3, the electronic control enclosure 303 is located within the collector 309. The elements shown in FIG. 3 share the last two digits with their corresponding elements in previous figures (e.g., motor 304 is substantially similar to motor 204). Unless specified here, the elements are understood to operate in the same manner as discussed above in previous embodiments.

The pump 300 includes a sealed motor housing 307 and a volute or collector 309. The collector 309 includes an inlet 310 and a discharge 311. An impeller 312 is operably coupled to the motor 304 by a shaft, such that the motor rotates the impeller 312. Rotation of the impeller 312 induces flow in a fluid in which the pump 300 is submerged, drawing fluid in through the inlet 310 and out through the discharge 311. The electronic control enclosure 303 is located in the collector 309 between the inlet 310 and the discharge 311. As fluid is pumped by the pump 300, some of the fluid flows along the surface of the enclosure 303, and heat transfers from the enclosure 303 to the fluid. The movement of the fluid increases the efficiency of the cooling as the heated fluid around the enclosure 303 flows past to be replaced by unheated fluid. In some forms the enclosure 303 includes a heat sink to further increase heat transfer with the fluid. Alternatively, the enclosure comprises the electrical components embedded in a solid, such as a potting compound.

This detailed description described specific examples of pumps. A person of ordinary skill in the art would recognize that these descriptions are sufficient to understand how to build and/or operate any of the pumps disclosed herein. In addition to these various embodiments, numerous methods are also disclosed and contemplated herein (e.g., methods of making or using the pumps and/or individual components of the pumps described). For example, a method of manufacturing a pump is disclosed herein that includes providing a pump with a DC motor housing and a DC motor connected via an output shaft to an impeller and having an external power control housing containing power circuitry to drop AC supply voltage down to DC voltage to power the DC motor. In preferred form, the method further comprises positioning the external power control housing below a predetermined position to ensure that it rests in fluid at least part of the time to allow the fluid to be used to dissipate heat generated from the power circuitry. The power circuitry preferably includes a transformerless circuit to convert AC supply voltage to DC voltage. In some forms, the external power control housing or compartment is formed integral with at least a portion of the pump housing or volute, rather than in the motor cap or top housing portion. In other forms, the external power control housing or compartment is formed separate from the pump. Of the lattermost embodiment, the separate power control housing or compartment may be connected to at least a portion of the pump in some embodiments or connected to other portions of the pump system in other embodiments (e.g., such as being connected to discharge pipes or plumbing, being connected to sump pits themselves or freestanding therein, etc.).

It should be understood that other methods are also disclosed herein and contemplated by this disclosure. For example, in addition to the above mentioned method of manufacturing a pump, a method of powering a DC motor with an AC power source is also disclosed and contemplated which includes positioning a power conversion circuit in a sealed compartment and below a fluid level line to use the fluid to help dissipate heat generated by the power control circuit. For example, in a utility or multi-use pump application, such as a pool cover pump, the pump may be configured with the power conversion circuit being positioned such that it rests within the fluid being pumped from the pool cover pump to help dissipate heat from the power conversion circuit. In other forms, methods for configuring a pump system are disclosed and contemplated having a sump pit or reservoir, a pump, a power control circuit and discharge tubing or plumbing and positioning the power control circuit at a position within the sump pit or reservoir such that the fluid being pumped by the pump is used for dissipating heat generated by the power control circuit. Other methods include methods related to making pump housing and/or power control compartment. In some forms, that entails forming the power control compartment integral to the pump housing and/or volute, rather than in the motor cap. While in other forms, the method entails forming the power control compartment separate from the pump housing, motor housing/motor cap and/or volute.

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. Also, elements illustrated in a certain embodiment can be combined with elements of other embodiments to form further exemplary embodiments. This detailed description does not, therefore, limit embodiments of the invention, which are defined only by the appended claims. Each of the embodiments described herein are contemplated as falling within the inventive subject matter, which is set forth in the following claims.

What is claimed is:

1. A pump assembly comprising:

a housing defining a motor cavity;

a motor disposed at least partially within the motor cavity;

a sealed power circuit enclosure separate and apart from the motor cavity;

a power circuit at least partially within the sealed power circuit enclosure; and a fluid collector having a fluid inlet and a fluid discharge, wherein the sealed power circuit enclosure is located within the fluid collector.

2. The pump assembly of claim 1 further comprising an impeller operatively coupled to the motor and positioned at least partially within the fluid collector.

3. The pump assembly of claim 1, wherein the sealed power circuit enclosure is positioned such that at least a portion of the power circuit enclosure is contacted by fluid when the housing is submerged in fluid.

4. The pump assembly of claim 1, wherein the motor is a permanent magnet motor.

5. The pump assembly of claim 1, wherein the power circuit comprises a rectifier.

6. The pump assembly of claim 5, the power circuit further comprising a capacitive water sensor.

7. The pump assembly of claim 1, wherein the sealed power circuit enclosure is connected to the collector such that a fluid flow induced by an impeller when the motor is operated causes fluid to flow past the sealed power circuit enclosure to aid in dissipating heat generated by the power circuit.

8. A pump assembly comprising:

a housing having an upper portion defining a motor cavity and a lower portion defining a collector;

a motor disposed at least partially within the motor cavity;

a sealed power circuit enclosure separate and apart from the motor cavity; and a power circuit for converting AC supply voltage to DC voltage disposed at least partially within the sealed power circuit enclosure, the power circuit electrically connected to the motor to provide electrical power to the motor, wherein the sealed power circuit enclosure is connected to the lower portion of the housing, wherein the collector has a fluid inlet and a fluid discharge and the sealed power circuit enclosure is located within the collector.

9. The pump assembly of claim 8, wherein the motor is a permanent magnet motor.

10. The pump assembly of claim 8 further comprising:

a conductive cable, configured to conduct electricity from the power circuit to the motor, extending from the housing to the sealed power circuit enclosure.

11. The pump assembly of claim 8, wherein the power circuit comprises a rectifier.

12. The pump assembly of claim 11, the power circuit further comprising a capacitive water sensor.

13. The pump assembly of claim 8, wherein the sealed power circuit enclosure is connected to the collector such that a fluid flow induced by the impeller when the pump motor is operated causes fluid to flow past the sealed power circuit enclosure to help dissipate heat generated by the power circuit.

14. The pump assembly of claim 8 further comprising an impeller operatively coupled to the motor and positioned at least partially within the collector.

15. A housing comprising:

a first compartment for storing at least a portion of a DC pump motor or impeller connected to the DC pump motor; and a second compartment separate from the first compartment for storing a power circuit for converting AC supply voltage to DC voltage to operate the DC pump motor, the second compartment being positioned to rest within a fluid surrounding the housing to dissipate heat generated by the power circuit, wherein the housing is a fluid chamber and the first compartment defines a passage for receiving at least a portion of the impeller connected to the DC pump motor and the fluid chamber further defines the second compartment separate from the first compartment.

16. A method of manufacturing a pump comprising:

providing a pump with a DC motor housing and a DC motor connected via an output shaft to an impeller and having an external power control housing containing power circuitry to convert AC supply voltage to DC voltage to power the DC motor; and positioning the external power control housing within a fluid chamber connected to the motor housing of the pump to allow the fluid flowing from an inlet to an outlet of the fluid chamber to be used to dissipate heat generated from the power circuitry.

17. The method of claim 16 further comprising forming the external power control housing integral to the fluid chamber.

18. A method of cooling a pump comprising:

providing a pump housing having a motor cavity and a fluid chamber, a motor being disposed in the motor cavity, the motor having an output shaft extending therefrom connected to an impeller, and the impeller at least partially disposed within the fluid chamber;

providing a sealed power control housing and a power converter positioned at least partially within the sealed power control housing;

positioning the sealed power control housing outside of the motor cavity such that it is configured to be contacted by fluid when the pump housing is at least partially submerged in the fluid; and connecting the sealed power control housing to at least one of the pump housing and the fluid chamber, wherein positioning the sealed power control housing comprises positioning the sealed power control housing within the fluid chamber.

19. The method of claim 18 wherein providing a power converter comprises providing a rectifier.

* * * * *